US006332809B1

(12) United States Patent
Tsukamoto

(10) Patent No.: US 6,332,809 B1
(45) Date of Patent: Dec. 25, 2001

(54) WATERPROOF CONNECTOR

(75) Inventor: Hisashi Tsukamoto, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/688,095

(22) Filed: Oct. 16, 2000

(30) Foreign Application Priority Data

Oct. 18, 1999 (JP) ..... 11-295015

(51) Int. Cl.[7] ..... H01R 13/40
(52) U.S. Cl. ..... 439/589
(58) Field of Search ..... 439/587, 589

(56) References Cited

U.S. PATENT DOCUMENTS 4,895,533 * 1/1990 Yagi et al. ..... 439/587
5,618,198 * 4/1997 Sato et al. ..... 439/274
5,766,039 * 6/1998 Abe ..... 439/587
6,132,249 * 10/2000 Saito et al. ..... 439/587

* cited by examiner

*Primary Examiner*—Tulsidas Patel
(74) *Attorney, Agent, or Firm*—Armstrong, Westerman, Hattori, McLeland & Naughton, LLP

(57) ABSTRACT

A waterproof connector, in which adhesion of rubber by unnecessary outflow thereof is prevented from occurring when a packing made of the rubber is molded in one body in a connector housing of the waterproof connector, is provided. The waterproof connector includes: a main chamber and a sub-chamber continuously formed in a connector housing of the waterproof connector with a step therebetween; a hole for introducing rubber penetratingly formed inside a wall of the sub-chamber arising from the step and communicating with a base of the connector housing; and a packing made of the rubber formed in one body in the main chamber and at the base of the connector housing.

3 Claims, 6 Drawing Sheets

WATERPROOF CONNECTOR

BACKGROUND OF THE INVENTION (1) Field of the Invention

This invention relates to a waterproof connector preventing rubber from unnecessarily adhering when packing made of the rubber is molded in one body in a connector housing of the waterproof connector.

(2) Description of the Related Art

FIGS. 7 through 12 show a conventional waterproof connector.

As to the conventional waterproof connector 24 (see FIG. 11), a packing 29 made of rubber is formed in one body within a female connector housing 28 made of synthetic resin. The connector housing 28 has two main chambers (chambers for mating connectors) 30 situated in parallel each other (see FIG. 7), each of which is contiguous to a small sub-chamber 33 situated at a base 32 side of the connector housing through a step 31 (see FIG. 8). On one inner wall 35 of the sub-chamber 33, there are provided a plurality of grooves 27 for introducing rubber, each of which communicates with a peripheral groove 34 (see FIG. 9) at the back of the base 32 of the connector housing. At the peripheral groove 34 side, a print circuit board (PCB; not shown in the figure) is arranged.

At an end of the inner wall 35 of the main chamber 30 and on an inner and outer surfaces of the base 32 of the connector housing, small projections for preventing the rubber from leaking are formed in a mating direction of the connectors. Each projection 36, 37 or 38 prevents molten rubber from leaking by being closely in contact with a mold 25 (shown by an alternate long and two short dashes line in FIG. 8) for casting.

The mold 25 is inserted into the connector housing 28 in a direction of arrow E (see FIG. 8) and comes in contact with the projections 36 and 37. The mold 25 has a wavelike lip-forming portion 25*a* and a rectangular block portion 25*b*, which enters into the sub-chamber 33. At the base 32 side of the connector housing, a mold 39 for casting having a V-shaped lip-forming porion 39*a* that continues to the peripheral groove 34 is placed.

Heated and molten rubber is injected from a gate 40 of the mold 25 into a gap between the mold 25 and the connector housing 28, thereby the packing 29 (see FIG. 11) is formed in one body within the connector housing 28. In the main chamber 30, a packing portion 29*a* (see FIGS. 10 and 11) for a mating male connector (not shown in the figure) is formed. The rubber flows into the peripheral groove 34 of the base 32 side of the connector housing through the groove 27 for introducing rubber (see FIG. 8), thereby another packing portion 29*b* (see FIGS. 11 and 12) is formed. A male terminal (not shown in the figure) at the PCB side is formed in the connector housing 28 by press-fit or integral molding, thereby the waterproof connector 24 is completed.

However, as to the conventional waterproof connector 24 described above, when the molten rubber is introduced into the groove 27 in a direction of arrow J in FIG. 13, the rubber enters into a small gap between the mold 25 and the connector housing 28 in directions of arrow G and arrow H, resulting in a formation of an unnecessary thin layer portion 41 (see FIG. 11) or unnecessary thick layer portion 42 on an inner wall 26 of the sub-chamber 33 or the step 31. Moreover, rubber injected from an opposite gate 40' (see FIG. 11) with respect to the groove 27 enters into a small gap between the mold 25 and the connector housing 28, similarly resulting in a formation of an unnecessary thin layer portion 41 or unnecessary thick layer portion 42. The formation of these layer portions causes unnecessary material cost-up due to the increased use of an amount of the rubber. In addition, since the unnecessary rubber adheres on the inner wall 26 of the connecter housing 28 or the step 31, there is such a fear that a mating condition between this waterproof connector and the mating connector (not shown in the figure) deteriorates.

Even when projections 43 and 44 for preventing the rubber from leaking are formed at the periphery of the groove 27 for introducing rubber and the step 31 as shown in FIG. 14 in order to solve the above problem, the projection 43 extended in an inserting direction of the mold is scraped off by an edge of the rectangular block portion 25*b* of the mold 25 (see FIG. 8), whereby the rubber leaks out in directions of arrow G and arrow K, resulting in no solution of the problem.

SUMMARY OF THE INVENTION

It is therefore an objective of the present invention to solve the above problem and to provide a waterproof connector, in which the unnecessary rubber never leaks out into the inner wall of the sub-chamber or the step between the main chamber and the sub-chamber of the connecter housing and the rubber is prevented from unnecessarily adhering, when a packing is molded in one body in the main chamber side and the base side of a connector housing of the waterproof connector.

In order to attain the above objective, the present invention is to provide a waterproof connector comprising: a main chamber and a sub-chamber continuously formed in a connector housing of the waterproof connector with a step therebetween; a hole for introducing rubber penetratingly formed inside a wall of the sub-chamber arising from the step and communicating with a base of the connector housing; and a packing made of the rubber formed in one body in the main chamber and at the base of the connector housing.

A groove for introducing rubber is formed on an inner wall of the main chamber, allowing the hole for introducing the rubber to be contiguous to the groove for introducing the rubber in one body.

Projections for preventing the rubber from leaking are formed closely in contact with a mold for casting and that continuously at a periphery of an opening of the hole for introducing the rubber and a whole periphery of the step.

DESCRIPTION OF THE PREFERRED EMBODIMENTS

In the following, a preferred embodiment of the present invention will be explained in detail with reference to the attached drawings.

FIGS. 1 to 6 illustrate an example of the waterproof connector according to the present invention.

Figure 1:
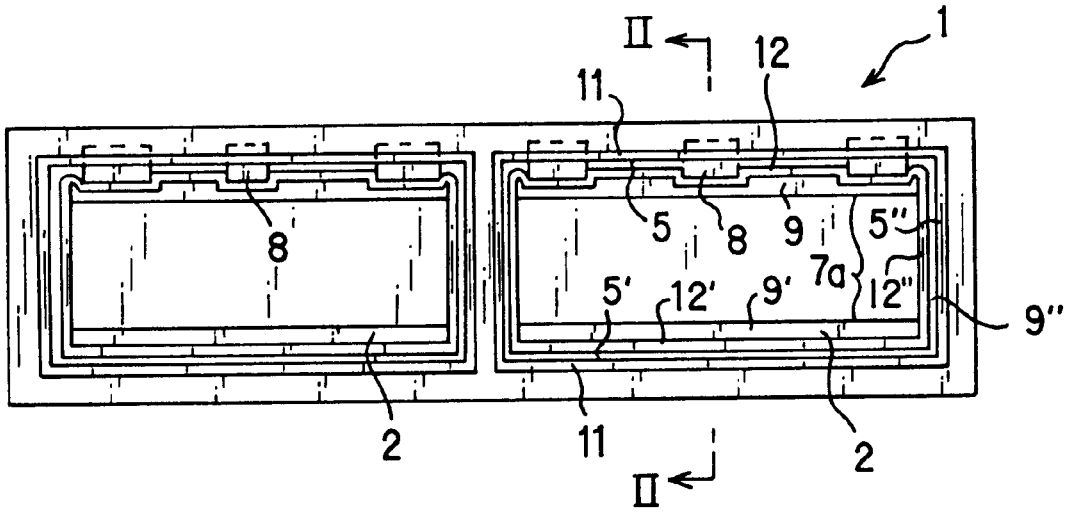
FIG. 1 is a front view of a connector housing of a waterproof connector according to the present invention.
Figure 2:
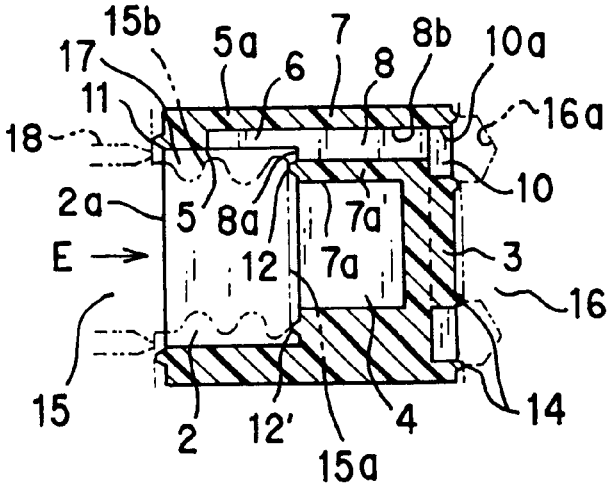
FIG. 2 is a sectional view taken along II—II line in FIG. 1.
Figure 4:
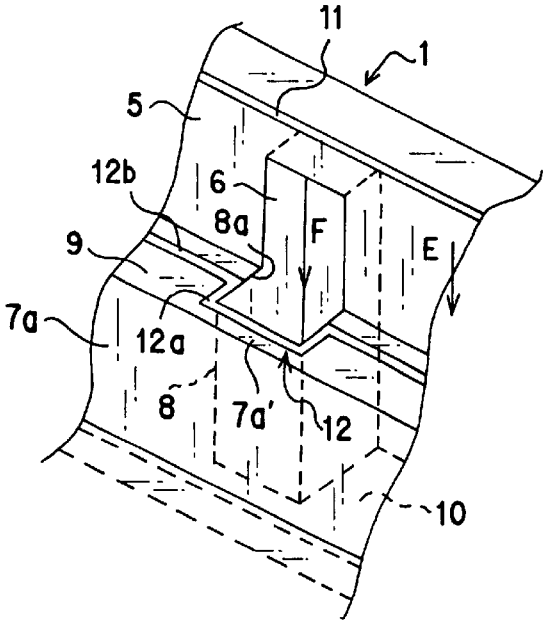
FIG. 4 is a perspective view illustrating a primary part of the connector housing.
Figure 5:
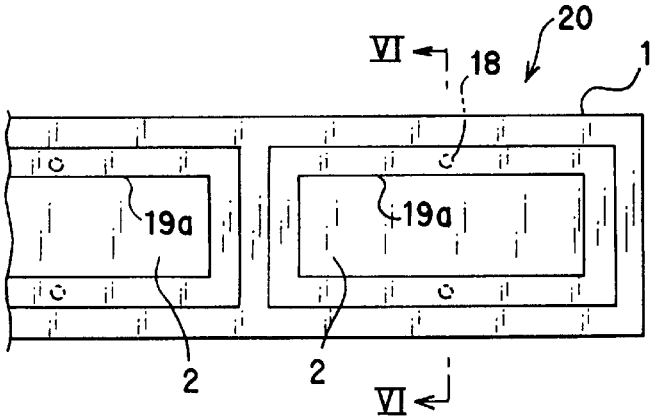
FIG. 5 is a front view of a waterproof connector, in which packings are formed in the connector housing.

As shown in FIG. 1, a connector housing 1 has two main chambers 2 (chambers for mating connectors) situated in parallel each other, each of which is contiguous to a sub-chamber 4 situated at a base 3 side of the connector housing 1 as shown in FIG. 2. As shown in FIG. 4 as well, a plurality of grooves 6 (three grooves in this example) for introducing rubber are formed on one inner wall 5 of the main chamber 2 and a hole 8 for introducing rubber, which is contiguous to the groove 6, is penetratingly formed inside a wall 7 of the sub-chamber 4 in a mating direction of the connectors (i.e. in an insertion direction of a mold for casting the rubber or in a direction of an arrow E in FIG. 4).

The groove 6 having a rectangular shape in section arises from an end of the inner wall 5 situating at a point a little apart from an opening 2*a* (see FIG. 2) of the main chamber 2 in the mating direction of the connectors and straightly extends in the insertion direction of a mold so as to be intergated with the hole 8 for introducing rubber.

The hole 8 having a rectangular shape in section arises from a step 9 situated between the inner wall 5 of the main chamber 2 and the inner wall 7*a* of the sub-chamber 4 and has an opening 8*a* (see FIG. 2) at the step 9, then straightly extends in the insertion direction of a mold so as to be intergated with the groove 6, penetrating through the base 3 and then, is in communication with a circular groove 10 situated at a PCB (not shown in the figure) side. A partition wall 5*a,* which is a part of the inner wall 5, is formed between the groove 6 and the exterior. Another partition wall 7*a',* which is a part of the inner wall 7*a,* is formed between the hole 8 and the sub-chamber 4. One inner surface 8*b* (see FIG. 2) of the hole 8 straightly continues to an inner surface 10*a* of the circular groove 10.

A small projection 11 for preventing the rubber from leaking is formed at a periphery of the opening 2*a*, i.e. at an end of the inner wall 5 of the main chamber 2 of the connector housing 1. Another projection 12 for preventing the rubber from leaking is formed at a periphery of the opening 8*a* of the hole 8 at the step 9 that extends to the inner wall 5, wherein the projection 12 surrounds about half of the opening 8*a* from the partition wall 7*a*' and straightly extends toward the periphery on the surface of the step 9. That is, the projection 12 consists of a half-surrounded portion 12*a* (see FIG. 4) and a straight portion 12*b* continuing to the half-surrounded portion 12*a*, wherein the straight portion 12*b* is situated near the inner wall 5.

Figure 3:
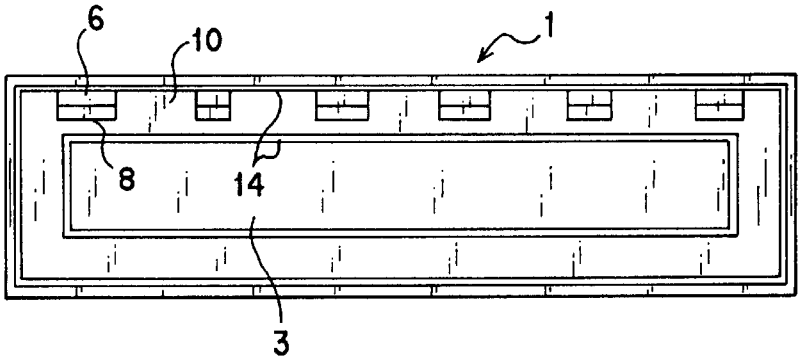
FIG. 3 is a rear view of the connector housing.

A projection 12' for preventing the rubber from leaking straightly extends at a step 9' (see FIG. 1), which extends to an opposite inner wall 5' of the main chamber 2, near the inner wall 5'. The projection 12' extends on a step 9" at a short side of the connecter housing crossing at right angles with a projection 12" that continues to the projection 12. Each projection 11, 12, 12' or 12" protrudes in the mating direction of the connectors (i.e. the insertion direction of the mold for casting rubber). As shown in FIGS. 2 and 3, a projection 14 for preventing the rubber from leaking is formed at the circular groove 10.

As shown by an alternate long and two short dashes line in FIG. 2, a mold 15 for casting comes in contact with the projection 11 of the inner wall 5, 5' and 5" side and the projections 12, 12' and 12" of the steps 9, 9' and 9", respectively, at the main chamber 2 side. While, the mold 16 comes in contact with the projection 14 near the circular groove 10 at the base 3 side. A bottom 15*a* of the mold 15 (see FIG. 2) abuts against the half-surrounded portion 12*a* of the hole 8 and the straight portion 12*b* at the step 9 (see FIG. 4).

Molten rubber is injected from a gate 18 into a gap 17 between a lip-forming portion 15*b* (see FIG. 2) and the inner wall 5 within the main chamber 2, thereby a packing 19 (see FIG. 6) is formed in one body with the connector housing 1. The injected rubber from the gate 18 (see FIGS. 5 and 6) forms a packing portion 19*a* for a mating connector (not shown in the figure) within the main chamber 2 and is fed into a gap the circular groove 10 at the base 3 side and a V-shaped groove 16a of the mold 16 after flowing through the groove 6 and the hole 8, thereby a packing part 19*b* at the PCB side is formed.

Figure 8:
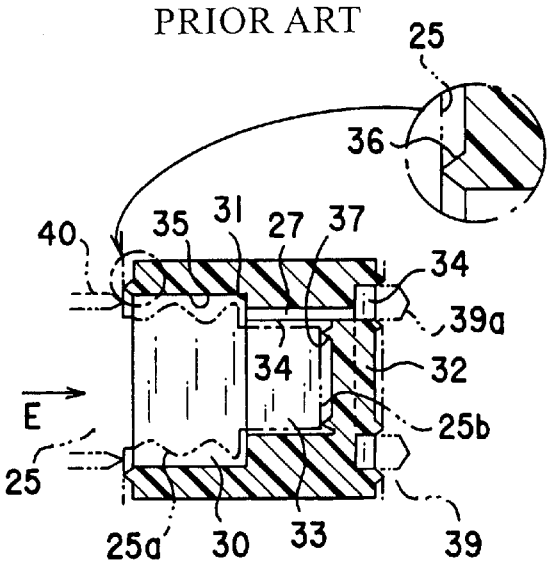
FIG.8 PRIOR ART
FIG. 8 is a sectional view taken along VIII—VIII line in FIG. 7.
Figure 9:
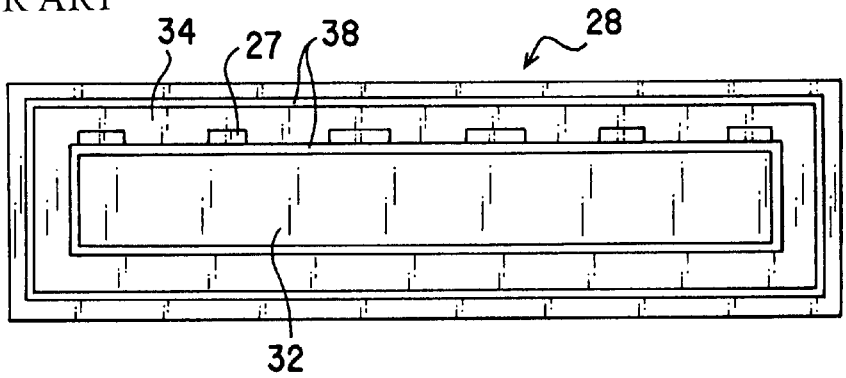
FIG.9 PRIOR ART
FIG. 9 is a rear view illustrating the connector housing of the conventional waterproof connector.
Figure 10:
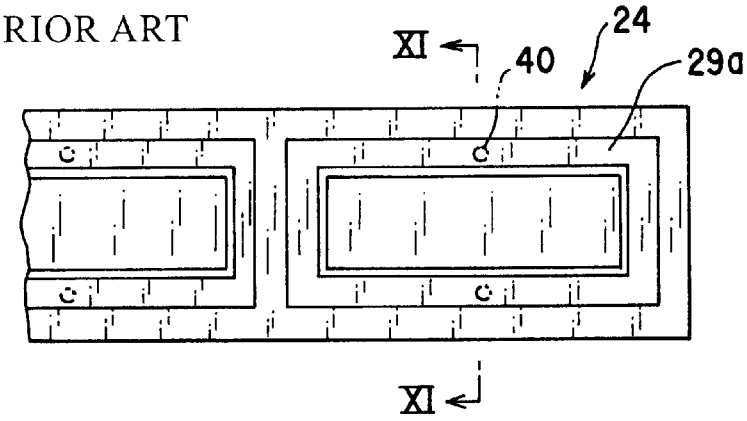
FIG.10 PRIOR ART
FIG. 10 is a front view illustrating the conventional waterproof connector.
Figure 11:
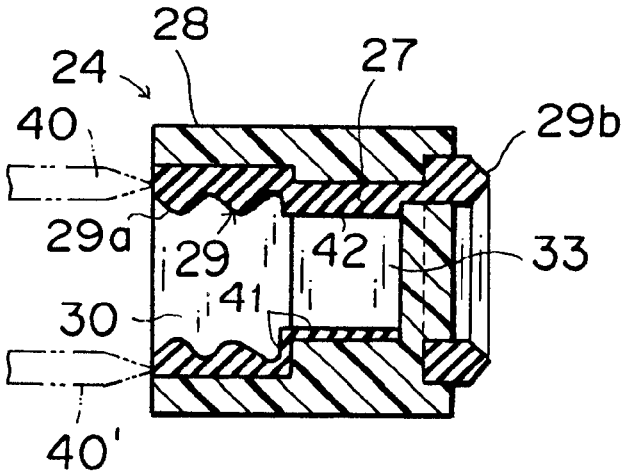
FIG. 11 PRIOR ART
FIG. 11 is a sectional view taken along XI—XI line in FIG. 10.
Figure 12:
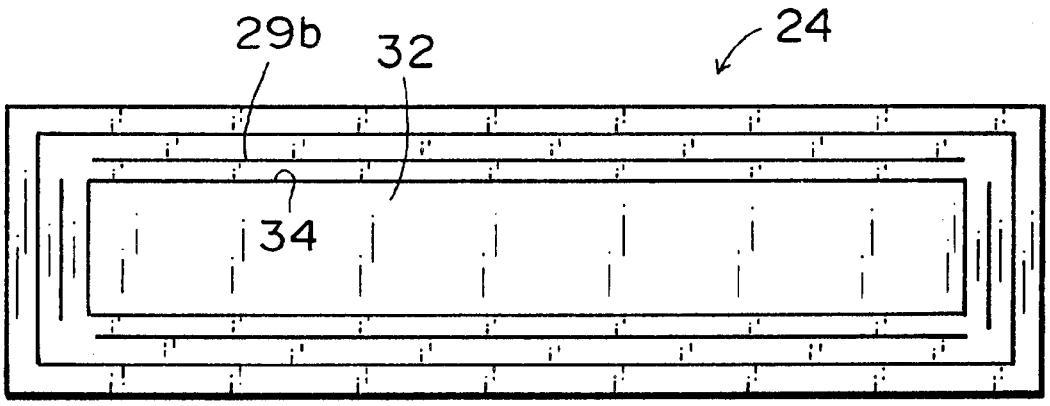
FIG. 12 PRIOR ART
FIG. 12 is a rear view illustrating the conventional waterproof connector.
Figure 13:
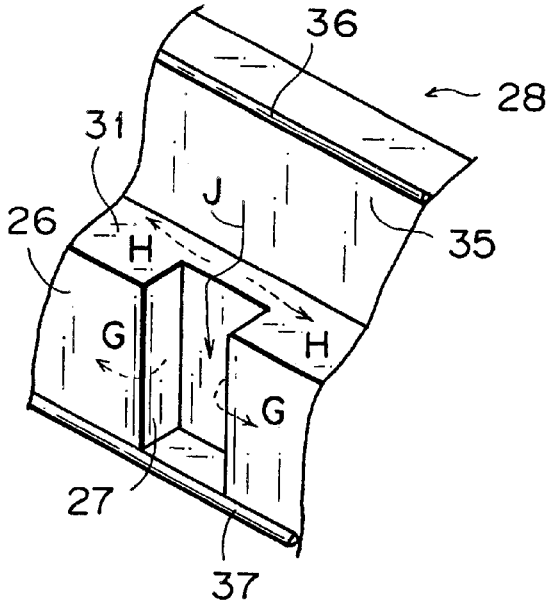
FIG. 13 PRIOR ART
FIG. 13 is a perspective view illustrating a problem of the conventional waterproof connector.
Figure 14:
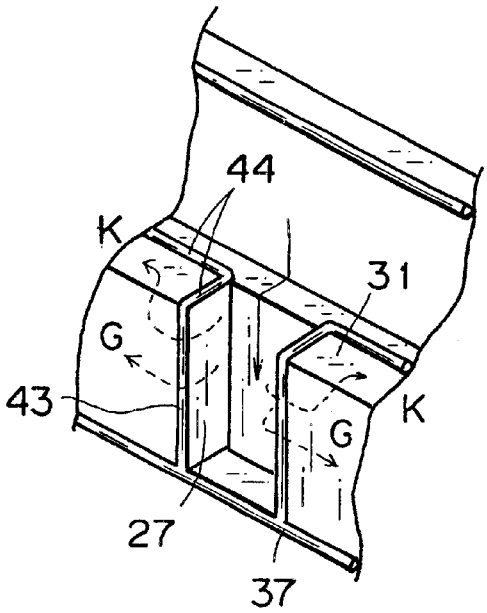
FIG. 14 PRIOR ART
FIG. 14 is a perspective view illustrating a problem of a modified conventional waterproof connector.

Since the rubber is fed to the circular groove 10 side not through a groove (as in the conventional art) but through a hole, a leak of the rubber, which takes place from a small gap between the mold 25 (see FIG. 8) and the inner wall 26 of the sub-chamber 33 as shown by the arrow G in FIG. 13 as to the conventional example, never occurs in this example according to the present invention, therefore, unnecessary adhesion of the rubber to the inner wall 7*a* of the sub-chamber 4 (see FIG. 6) never takes place. Since only the rubber corresponding to a volume of the hole 8 is fed into the hole 8, unnecessary feed of the rubber into the groove 27 (see FIG. 11), as is occurred in the conventional example, never takes place. In addition, as to this example according to the present invention, the groove 6 allows the introduction of the rubber to take place securely and smoothly as a guide for the rubber to flow into the hole 8 as shown by an arrow F in FIG. 4 and also makes the volume of the hole 8 so as to allow the flow of the rubber to occur quickly and securely.

Since the projections 12, 12' and 12" are formed at the periphery of the hole 8 or on the surface of the steps 9, 9' and 9" and the mold 15 for casting abuts against the projections 12, 12' and 12" in an insertion direction of the mold 15, therefore, the rubber between the mold 15 and the inner walls 5, 5' and 5" is prevented from leaking into the inside (the inner wall 7*a* side of the sub-chamber 4), thereby unnecessary adhesion of the rubber onto the steps 9, 9' and 9" or the inner wall 7*a* of the sub-chamber 4 can be prevented from occurring.

Figure 6:
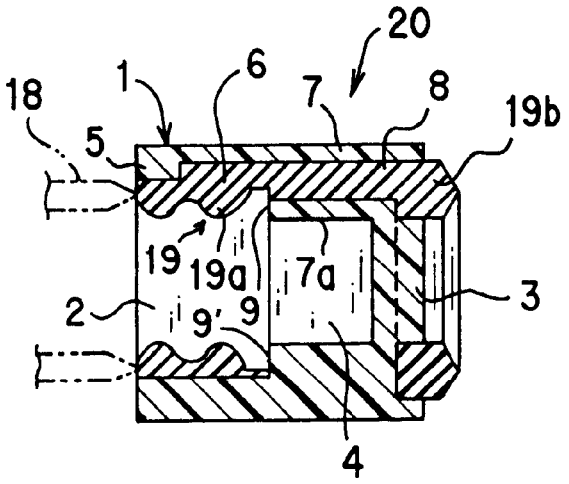
FIG. 6 is a sectional view taken along VI—VI line in FIG. 5.
Figure 7:
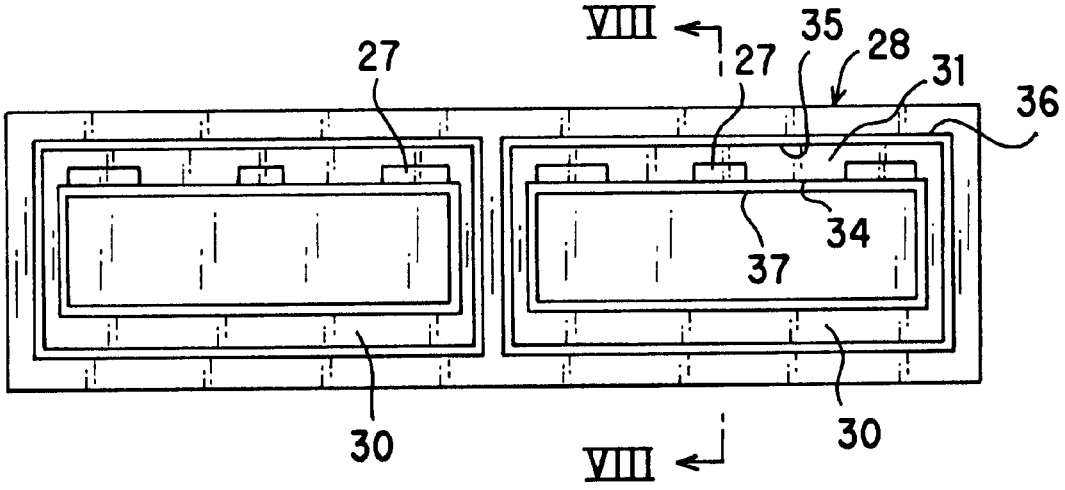
FIG.7 PRIOR ART
FIG. 7 is a front view illustrating a connector housing of a conventional waterproof connector.

As shown in FIG. 6, the rubber never adheres to the inner wall 7*a* and the step 9' and the packing 19 is formed in one body with the connector housing 1. In contrast to the conventional example (see FIG. 11), since the unnecessary adhesion of the rubber never takes place, the using amount of the rubber decreases and the production cost of the waterproof connector is reduced.

A waterproof connector 20 includes the connector housing 1, the packing 19 and a terminal (not shown in the figure) to be inserted in the connector housing 1. The waterproof connector 20 according to the present invention is characterized in that it also includes the groove 6 for introducing rubber provided on the inner wall 5 of the main chamber 2 of the connector housing 1 and the hole 8 for introducing rubber, which arises from the step 9 situated between the main chamber 2 and the sub-chamber 4 and penetratingly extends inside the wall 7 of the sub-chamber 4. The projections 12, 12' and 12" for preventing the rubber from leaking are continuously formed at the periphery of the opening 8*a* of the hole 8 near the sub-chamber 4 around the step 9 and the whole periphery of the steps 9, 9' and 9". The groove 6 and the hole 8 are filled with the rubber, then the packing portion 19*a* in the main chamber 2 and the packing part 19*b* at the circular groove 10 that continues to the hole 8. Unnecessary adhesion of the rubber onto the steps 9, 9' and 9" or the inner wall 7*a* of the sub-chamber 4 never takes place.

As to the example of the waterproof connector described above, the connector housing 1 has two main chambers 2 in parallel each other, however, the connector housing 1 may have one main chamber or more than two main chambers instead. The construction of the waterproof connector described above is also useful as a process for producing a waterproof connector.

The aforementioned preferred embodiments are described to aid in understanding the present invention and variations may be made by one skilled in the art without departing from the spirit and scope of the present invention.

According to the main feature of the present invention, since molten rubber is introduced up to the base side of the connector housing by flowing through the hole for introducing the rubber, the unnecessary adhesion of the rubber onto the wall of the sub-chamber never takes place, unnecessary outflow of the rubber is prevented from occurring, the using amount of the rubber decreases and the production cost of the waterproof connector is reduced. Moreover, since the molten rubber is smoothly guided into the hole for introducing the rubber via the groove for introducing the rubber formed on an inner wall of the main chamber, unnecessary outflow of the rubber is more securely prevented from occurring. In addition, since the projections for preventing the rubber from leaking are formed closely in contact with a mold for casting, outflow of the rubber from the opening of the hole for introducing the rubber is prevented from occurring, therefore, a leak of the rubber along the inner wall of the main chamber never takes place, thereby the packing is securely attained.

What is claimed is:

1. A waterproof connector comprising:

a main chamber and a sub-chamber continuously formed in a connector housing of the waterproof connector with a step therebetween;

a hole for introducing rubber penetratingly formed inside a wall of the sub-chamber arising from the step and communicating with a base of the connector housing; and a packing made of the rubber formed in one body in the main chamber and at the base of the connector housing.

2. The waterproof connector according to claim 1, wherein a groove for introducing rubber is formed on an inner wall of the main chamber, allowing the hole for introducing the rubber to be contiguous to the groove for introducing the rubber in one body.

3. The waterproof connector according to claim 1 or 2, wherein projections for preventing the rubber from leaking are formed closely in contact with a mold for casting and continuously at a periphery of an opening of the hole for introducing the rubber and a whole periphery of the step.

* * * * *